US005586834A

United States Patent [19]

Tsuji

[11] Patent Number: 5,586,834

[45] Date of Patent: Dec. 24, 1996

[54] JOINT STRUCTURE FOR COUPLING PRECAST CONCRETE PAVEMENT SLABS

[75] Inventor: Tomoyuki Tsuji, Otaru, Japan

[73] Assignee: Otaru Development and Construction Department of Hokkaido Development Bureau, Japan

[21] Appl. No.: 320,926

[22] Filed: Oct. 11, 1994

[30] Foreign Application Priority Data

Apr. 8, 1994 [JP] Japan ..... 6-071092

[51] Int. Cl.[6] ..... E01C 11/14

[52] U.S. Cl. ..... 404/60; 404/62

[58] Field of Search ..... 404/51, 52, 56, 404/58, 59, 60, 61, 62, 63, 73

[56] References Cited

U.S. PATENT DOCUMENTS

| | | | |
|---|---|---|---|
| 2,163,397 | 6/1939 | Friberg | 404/63 |
| 2,308,677 | 1/1943 | Dailey | 404/52 X |
| 4,449,844 | 5/1984 | Larsen | 404/59 X |

FOREIGN PATENT DOCUMENTS

| | | | |
|---|---|---|---|
| 1083295 | 6/1960 | Germany | 404/56 |
| 58-7003 | 1/1983 | Japan . | |
| 261502 | 11/1986 | Japan . | |

*Primary Examiner*—David J. Bagnell
*Assistant Examiner*—James A. Lisehora
*Attorney, Agent, or Firm*—Quarles & Brady

[57] ABSTRACT

A joint structure for coupling adjacent precast concrete pavement slabs which is excellent in execution process for pavement, particularly is capable of ensuring the sliding of a reinforcing bar. A first horizontal hole for accommodating a reinforcing bar thereinto is provided at an end surface of the first precast concrete pavement slab. A second horizontal hole for inserting a distal end of the reinforcing bar is provided at an end surface of a second precast concrete pavement slab. Both horizontal holes have the same diameters, opposite in position to each other. A guide passage is defined through the second precast concrete pavement slab for its upper surface to communicate with its inner end surface. A hauling member is connected to a distal end of the reinforcing bar so that it may be inserted into the guide passage. According to the invention, the distal end of the hauling member is drawn close so that the reinforcing bar can easily slide through the first horizontal hole toward the second horizontal hole.

9 Claims, 4 Drawing Sheets

1
3
4
10
12
12A
6
4A
1A
21
5A
5
14
2
7
8
9
9A
11
11A
13

JOINT STRUCTURE FOR COUPLING PRECAST CONCRETE PAVEMENT SLABS

BACKGROUND OF THE INVENTION (a) Field of the Invention

The present invention relates to a joint structure for coupling precast concrete pavement slabs, which is applied to pavement process in general.

(b) Description of Prior Art

In recent years, precast concrete pavement slabs have been widely employed for repairing or newly-paving a road, as it is advantageous both in its execution and abrasion resistance.

According to such prior execution process with the precast concrete pavement slabs, the pavement slabs laid on a road are coupled with one another by reinforcing bars, and then the rear faces of the pavement slabs are charged with filler material such as grout or the like.

A prior joint structure for coupling precast concrete pavement slabs is such that one end face of a first pavement slab is formed with one horizontal longitudinal hole (hereinafter one horizontal hole) for housing a reinforcing bar, while the other end face of a second pavement slab opposite to the first pavement slab is formed with the other longitudinal horizontal hole (hereinafter the other horizontal hole) for inserting nearly a distal half of the longitudinal length of the reinforcing bar. Then, the adjacent pavement slabs are mated and laid on a road with the reinforcing bar housed in one horizontal hole, and subsequently thereto, the reinforcing bar is slid toward the other horizontal hole. After that, filler such as grout or the like is charged into both horizontal holes for conjuction of the adjacent pavement slabs.

As a means for sliding the reinforcing bar, it has been known that an upper part of one horizontal hole is formed with an aperture, into which is inserted a hand to manually slide the reinforcing bar. Further, Japanese Patent Laid-Open No 58-7003 teaches that the reinforcing bar is slid by pushing its back by means of pressurized air or wires.

However, with the structure of the prior art having the aperture provided at an upper part of one horizontal hole, the reinforcing bar must be manually slid by an operator, thus resulting in low efficiency. Further, with another prior art such as sliding reinforcing bar by means of pressurized air or the like, packings or the like must be provided at the back of the reinforcing bar to transmit the force of the pressurized air thereto. In which case, in the event that the air-tightness between the packing and the horizontal hole is insufficient or low, the reinforcing bar cannot be slid well. Furthermore, according to the prior art, as the other horizontal hole for insertion of the distal half of the reinforcing bar must be formed to have a larger diameter than that of one horizontal hole, its casting process will inevitably become complicated, and such difference between the diameters can even cause the irregularity of the connection strength after having charged the holes with filler.

In addition, in case that there is a gap in position between the adjacent horizontal holes, the distal end of the reinforcing bar will strike on a peripheral edge of the other horizontal hole, thus preventing the bar from further advancing. In such a case, there have been some fear that filler will be charged by mistake with only a part of the distal portion of the reinforcing bar being inserted into the other horizontal hole.

SUMMARY OF THE INVENTION

To eliminate the above-mentioned problems, it is, therefore, an object of the present invention to provide a joint structure for coupling adjacent precast concrete pavement slabs with an excellent execution process.

It is another object of the present invention to provide a joint structure which can ensure the sliding of are inforcing bar.

According to a major feature of the present invention, there is provided a joint structure for coupling adjacent precast concrete pavement slabs comprising: a first horizontal hole defined through a first outer end surface of a first precast concrete pavement slab; a second horizontal hole defined through a second outer end surface of a second precast concrete pavement slab, said second horizontal hole being opposite to the first horizontal hole; a reinforcing bar which is accommodated into the first horizontal hole and then inserted into the second horizontal hole; a guide passage defined through the second precast concrete slab, thus an inner end surface of the second horizontal hole communicating with an upper surface thererof; a flexible hauling member connected to a distal end of the reinforcing bar, said flexible hauling member being insertable into the guide passage.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Figures 1, 1A:
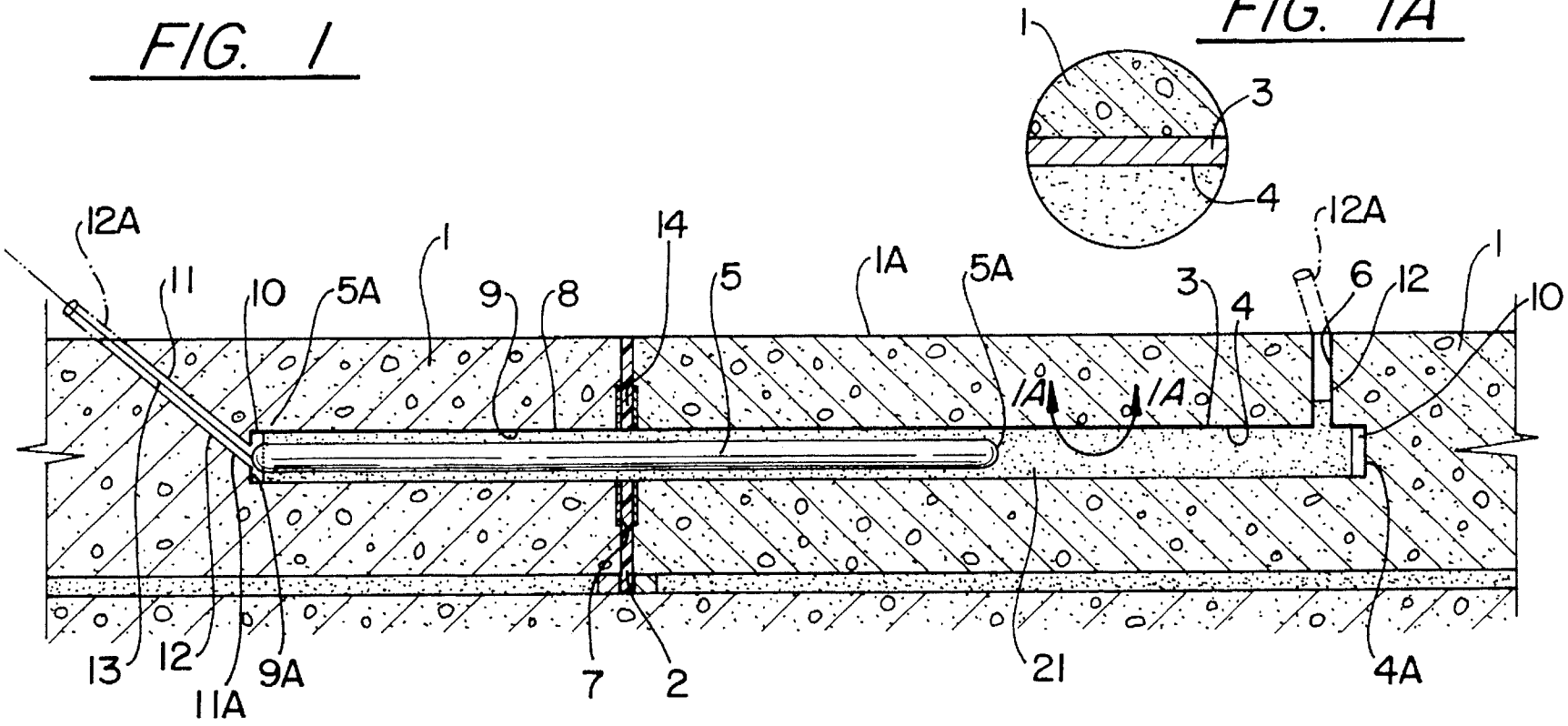
FIG. 1 is a cross sectional view showing an embodiment of a joint structure for coupling adjacent precast concrete pavement slabs of the invention.
FIG. 1A is an enlarged view showing details of the arrangement of the slab 1, sheathing member 3 and the horizontal hole 4.

Hereinafter is described an embodiment of the invention with reference to the attached drawings.

In FIGS. 1 to 4 showing an embodiment of the invention, 1 designates a square-shaped precast concrete pavement slab (hereinafter called pavement slab). In an outer end face 2 of a first pavement slab 1 are securely embedded a plurality of sheathing members 3 made of steel pipes to construct a first horizontal hole 4, which is formed cylindrical, having such a sufficient longitudinal length as to accommodate a reinforcing bar 5. At the proximal side of the first horizontal hole 4 is vertically defined a filler hole 6 through the pavement slab 1.

In an other outer end face 7 of a second pavement slab 1 are also securely embedded other sheathing members 8 made of steel pipes, corresponding to the said first horizontal hole 4. Thus, a second horizontal hole 9 is constructed, which is also formed cylindrical, having the same diameter as that of the first horizontal hole 4 and nearly half the longitudinal length of the reinforcing bar 5. In addition, there is provided a cap 10 made of synthetic resin such as vinyl chloride at an inner end face 9A of the second horizontal hole 9.

For the center of the said inner end face 9A to communicate with an upper surface of the second pavement slab 1, there is provided a straight guide passage 11 obliquely extending from the former to the latter, said guide passage permitting a vinyl hose 12 made of synthetic resin to be inserted therethrough. Further, there is also provided another cap 10 at another inner end face 4A of the first horizontal hole 4.

The reinforcing bar 5 is formed of round steel or the like, of which the both ends are formed with semispherical portions 5A,5B respectively to thereby be smoothly inserted into the both horizontal holes 4 and 9. The distal end of the reinforcing bar 5 is connected to a flexible hauling member 13 made of a flexible member such as wire or the like. In the drawings, reference number 14 designates a joint plate interposed between the said outer end faces 2 and 7, while 11A designates a guide tube made of synthethic resin, which is disposed in a lower portion of the guide passage 11 as shown in FIG. 4.

Figure 4:
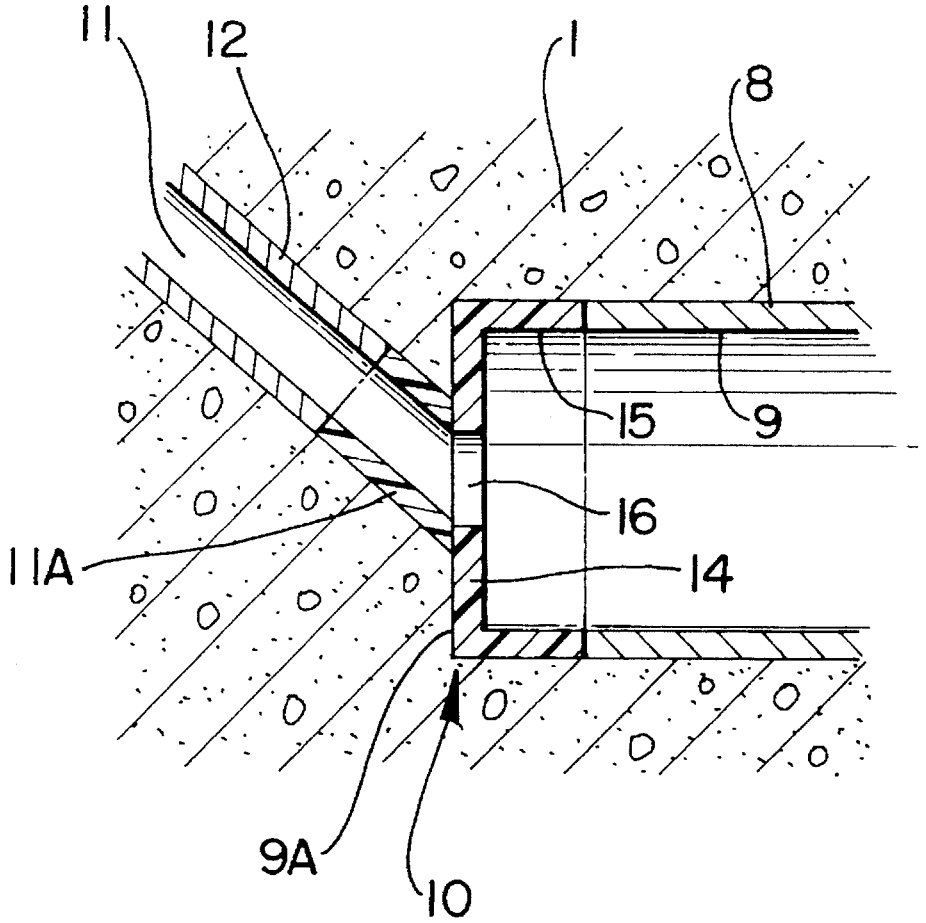
FIG. 4 is an enlarged section showing a neighborhood of a cap of an embodiment of the present invention.

Referring to FIG. 4, each cap 10 comprises a circular plate 14 and a cylindrical portion 15 integrated therewith, said circular plate 14 having a guide hole 16 defined therethrough at the center thereof, to which is connected the guide tube 11A integral with the circular plate 14. Whilst, into the filler hole 6 and the guide passage 11 are inserted the vinyl hoses 12 respectively, of which the upper ends 12A are protruding from the upper surfaces 1A of the pavement slabs 1 so that the upper ends 12A can serve as connecting apertures for nozzles of a filler charging device (not shown).

Hereinbelow is described a method of coupling the adjacent pavement slabs thus structured in the invention.

Figure 2:
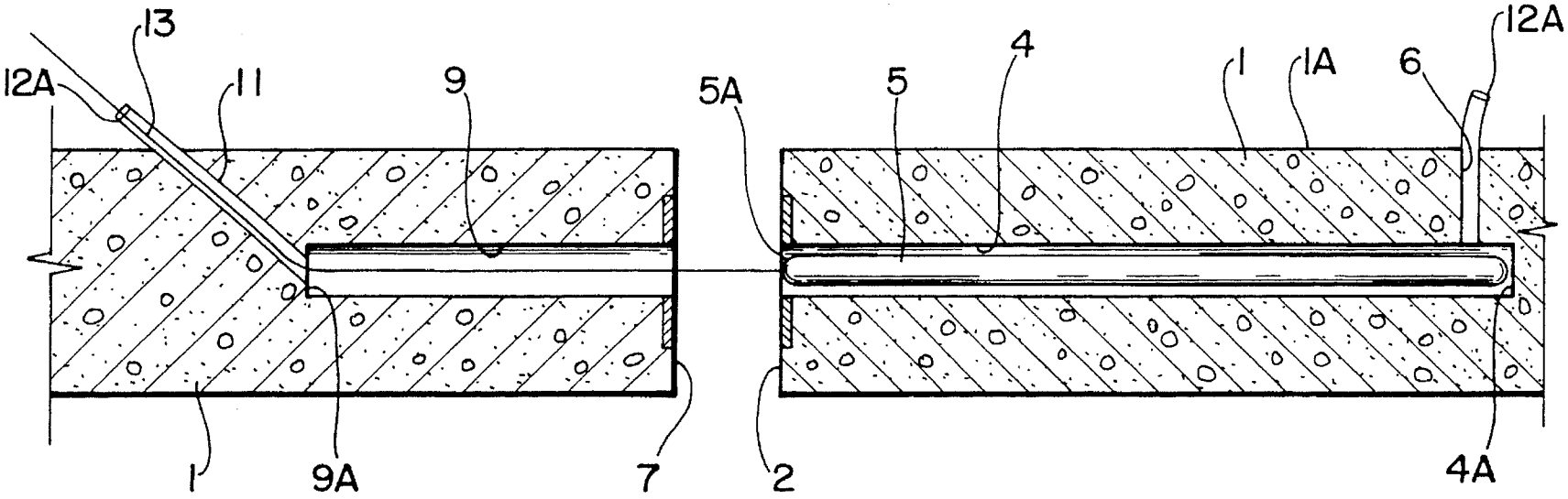
FIG. 2 is also a cross sectional view showing an embodiment of a joint structure for coupling adjacent precast concrete pavement slabs of the invention.

Referring to FIG. 2, the reinforcing bar 5 is accommodated into the first horizontal hole 4 of the first pavement slab 1, while the flexible hauling member 13 connected to the distal end of the reinforcing bar 5 is inserted into the second horizontal hole 9 of the second pavement slab 1, and then, the distal end of the hauling member 13 is further inserted into the guide passage 11. Thereafter, the adjacent pavement slabs 1 are mated and laid with the opposite end surfaces 2, 7 contacting each other.

Figure 3:
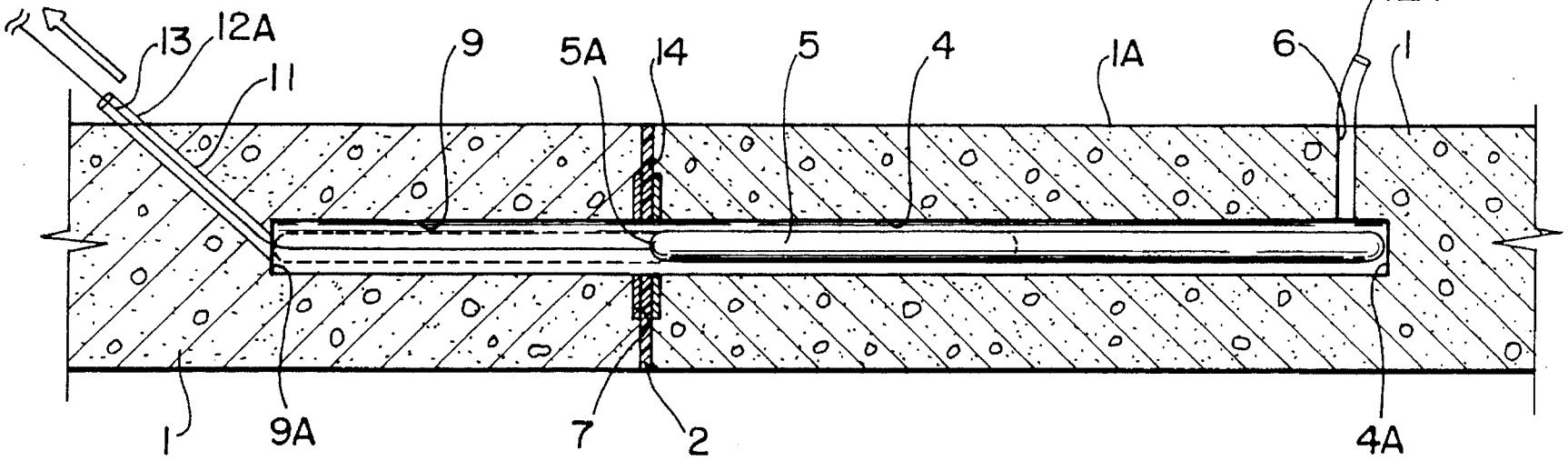
FIG. 3 is another cross sectional view showing an embodiment of a joint structure for coupling adjacent precast concrete pavement slabs of the invention.

Referring to FIG. 3, the distal end of the flexible hauling member 13 is pulled up so that the reinforcing bar 5 may slide toward the second horizontal hole 9 until the distal end thereof strikes on the cap 10 and stops there, thus disposing the reinforcing bar 5 intermediately of the both pavement slabs 1.

Owing to the above described structures, the flexible hauling member 13 will not directly slide on a concrete member or the like, but be smoothly drawn closer with the same guided by the guide tube 11A and vinyl hose 12, thus preventing the same from breaking on the way. Further, as the distal end of the reinforcing bar 5 is formed with the semispherical portion 5A, the above smooth movement can be ensured in spite of the gap in position between the adjacent two horizontal holes 4 and 9.

After the above process, the surplus or protruding portion of the hauling member 13 is severed, and at the same time, both horizontal holes 4 and 9 are charged with the filler 21 such as grout through the filler hole 6 and guide passage 11. In this case, nozzles of the filler charging device are connected to the vinyl hoses 12 protruding from the upper surfaces 1A of the pavement slabs 1, thus easily charging the horizontal holes 4 and 9 with the filler 21 therefrom.

In accordance with the above-described embodiment of the invention, there is provided the guide passage 11 defined from the inner end face of the second horizontal hole 9 of the second pavement slab 1 up to the upper surface 1A thereof, while the flexible hauling member 13 insertable into the guide passage 11 is connected to the distal end of the reinforcing bar 5, whereby the reinforcing bar 5 is accommodated into the first horizontal hole 4 so that the flexible hauling member 13 connected to the distal end thereof may be inserted into the second horizontal hole 9 of the adjacent second pavement slab 1. Then, both of the pavement slabs 1 are laid down after having matched the horizontal holes 4, 9. Thereafter, the distal end of the flexible hauling member 13 protruding from the guide passage 11 is drawn closer so that the reinforcing bar 5 can be allowed to slide toward the second horizontal hole 9.

Accordingly, unlike the prior art where a back of the reinforcing bar is pushed to move the same, the hauling member 13 of the invention can lead the way toward the travelling direction of the reinforcing bar 5 and allow the reinforcing bar 5 to slide, thereby enabling the smoothly travelling of the same with the hauling member 13 in the lead. Further, the drawn length of the hauling member 13 can give a proper indication of the travelling distance of the reinforcing bar 5 within the horizontal holes 4 and 9. Furthermore, as the reinforcing bar 5 is led by the hauling member 13, it can be smoothly shifted toward the second horizontal hole 9 in spite of the same diameters of the holes 4 and 9, which can contribute to excellent connection strength after having charged with filler 21.

In addition, according to an embodiment of the invention, there is provided the semispherical portion 5A formed at the distal end of the reinforcing bar 5, whereby the frictional resistance between the reinforcing bar 5 and the horizontal holes 4,9 can be lessened during travelling of the reinforcing bar 5. Further, the reinforcing bar 5 is drawn by the hauling member 13 until it strikes on the cap 10 provided at the inner end surface 9A, thereby giving an indication of proper location thereof. Furthermore, there is provided a straight guide passage 11 obliquely extending, into which is inserted the vinyl hose 12, whereby the hauling member 13 inserted thereinto can be smoothly drawn near.

Additionally, as both horizontal holes 4 and 9 are formed from steel pipes, the frictional resistance between the reinforcing bar 5 and the horizontal holes 4,9 can be more lessened as contrasted to concrete inner walls.

Besides, as each distal end 12A of the vinyl hoses 12 inserted into the filler hole 6 and the guide passage 11 respectively protrudes from each upper surface 1A of the pavement slabs 1, thus saving a trouble of adjusting the nozzles to small holes. That is, according to the invention, the nozzles can be directly connected to the distal ends 12A of the vinyl hoses 12 so that the filler material 21 can be injected through the small filler hole 6 and the guide passage 11. After that, the distal ends 12A have only to be severed.

Incidentally, the present invention should not be limited to the above described embodiment, but can be modified within a scope of the invention. For example, the flexible hauling member should not be limited to wire, but may be formed of any other linear member having flexibility.

What is claimed:

1. A joint structure for coupling adjacent precast concrete pavement slabs comprising:

a first horizontal hole defined through a first outer end surface of a first precast concrete pavement slab;

a second horizontal hole defined through a second outer end surface of a second precast concrete pavement slab, said second horizontal hole being opposite to the first horizontal hole and having an inner end surface;

a reinforcing bar having a distal end, said reinforcing bar accommodated into the first horizontal hole and then inserted into the second horizontal hole, said distal end formed semispherical;

the second precast concrete slab having an upper surface and a straightened guide passage defined therethrough which guide passage is provided to allow said inner end surface of the second horizontal hole to communicate with said upper surface, and said guide passage having a vinyl hose inserted therethrough;

a flexible hauling member connected to the distal end of the reinforcing bar, said flexible hauling member being insertable into the guide passage;

wherein said first and second horizontal holes are provided by securely embedding sheathing members made of steel pipes in the first and second outer end surfaces of the first and second precast concrete pavement slabs respectively, said sheathing members being cylinder-shaped, having the same diameters.

2. A joint structure for coupling adjacent precast concrete pavement slabs according to claim 1, wherein the first horizontal hole is long enough to accommodate the reinforcing bar, while the second horizontal hole has approximately half the length of the reinforcing bar.

3. A joint structure for coupling adjacent precast concrete pavement slabs according to claim 2, wherein said reinforcing bar is made of round steel or the like.

4. A joint structure for coupling adjacent precast concrete pavement slabs comprising:

a first horizontal hole defined through a first outer end surface of a first precast concrete pavement slab;

a second horizontal hole defined through a second outer end surface of a second precast concrete pavement slab, said second horizontal hole being opposite to the first horizontal hole and having an inner end surface;

a reinforcing bar having a distal end, said reinforcing bar accommodated into the first horizontal hole and then inserted into the second horizontal hole;

the second precast concrete slab having an upper surface and a guide passage defined therethrough, which guide passage is provided to allow said inner end surface of the second horizontal hole to communicate with said upper surface;

a flexible hauling member connected to the distal end of the reinforcing bar, said flexible hauling member being insertable into the guide passage;

a cap made of synthetic resin provided at the inner end surface of the second horizontal bole, said cap comprising a circular plate provided at the inner end surface of the second horizontal hole;

a cylindrical portion integral with the circular plate;

a guide hole provided at the center of the circular plate, said guide hole communicating with the guide passage.

5. A joint structure for coupling adjacent precast concrete pavement slabs according to claim 4, wherein a guide tube made of synthetic resin is connected to the guide hole, said guide tube being inserted into said guide passage.

6. A joint structure for coupling adjacent precast concrete pavement slabs comprising:

a first horizontal hole defined through a first outer end surface of a first precast concrete pavement slab, said first horizontal hole having an inner end surface, said first precast concrete pavement slab having an upper surface;

a second horizontal hole defined through a second outer end surface of a second precast concrete pavement slab, said second horizontal hole being opposite to the first horizontal hole, and having an inner end surface;

a reinforcing bar having a distal end, said reinforcing bar accommodated into the first horizontal hole and then inserted into the second horizontal hole;

the second precast concrete slab having an upper surface and a guide passage defined therethrough, which guide passage is provided to allow said inner end surface of the second horizontal hole to communicate with said upper surface;

a flexible hauling member connected to the distal end of the reinforcing bar, said flexible hauling member being insertable into the guide passage;

a filler hole in the first precast concrete slab which is provided to allow a neighborhood of said inner end surface of the first horizontal hole to communicate with said upper surface of said first precast concrete pavement slab;

wherein said filler hole has a vinyl hose inserted therethrough, of which the upper end protrudes from the upper surface of the first precast concrete pavement slab so that it can be easily connected to nozzles of a filler charging device;

wherein said guide passage has a vinyl hose inserted therethrough, of which an upper end protrudes from the upper surface of the second precast concrete pavement slab.

7. A joint structure for coupling adjacent precast concrete pavement slabs comprising:

a first horizontal hole defined through a first outer end surface of a first precast concrete pavement slab;

a second horizontal hole defined through a second outer end surface of a second precast concrete pavement slab, said second horizontal hole being opposite to the first horizontal hole, and having an inner end surface;

a reinforcing bar having a distal end, said reinforcing bar accommodated into the first horizontal hole and then inserted into the second horizontal hole, said distal end formed semispherical;

the second precast concrete slab having an upper surface and a straightened guide passage defined therethrough, which guide passage is provided to allow said inner end surface of the second horizontal hole to communicate with said upper surface, said guide passage having a vinyl hose inserted therethrough;

a flexible hauling member connected to said distal end of the reinforcing bar, said flexible hauling member being insertable into the guide passage, said flexible hauling member being formed of wire or the like;

wherein said first and second horizontal holes are provided by securely embedding sheathing members made of steel pipes in the first and second outer end surfaces of the first and second precast concrete pavement slabs respectively, said sheathing members being cylinder-shaped, having the same diameters.

8. A joint structure for coupling adjacent precast concrete pavement slabs according to claim 7, wherein the first horizontal hole is long enough to accommodate the reinforcing bar, while the second horizontal hole has approximately half the length of the reinforcing bar.

9. A joint structure for coupling adjacent precast concrete pavement slabs according to claim 8, wherein said reinforcing bar is made of round steel or the like.

* * * * *